United States Patent [19]

Vechot

[11] 4,246,724

[45] Jan. 27, 1981

[54] AEROPLANE WITH CIRCULAR FLIGHT

[75] Inventor: Bernard Vechot, Paris, France

[73] Assignee: Compagnie Generale du Jouet Importation en abrege C.E.J.I. Import, France

[21] Appl. No.: 30,159

[22] Filed: Apr. 16, 1979

[30] Foreign Application Priority Data

Mar. 16, 1979 [FR] France ..... 79 06767

[51] Int. Cl.[3] ..... A63H 17/00

[52] U.S. Cl. ..... 46/249; 46/77

[58] Field of Search ..... 46/249, 77, 78; 43/44.83

[56] References Cited

U.S. PATENT DOCUMENTS

| | | | |
|---|---|---|---|
| 2,439,054 | 4/1948 | Mosthof | 46/249 |
| 2,968,119 | 1/1961 | Glass et al. | 46/249 |
| 3,148,423 | 9/1964 | Anspach | 43/44.83 X |
| 3,579,905 | 5/1971 | Radford | 46/249 X |

FOREIGN PATENT DOCUMENTS

| | | | |
|---|---|---|---|
| 595896 | 4/1960 | Canada | 46/249 |

*Primary Examiner*—Robert Peshock
*Assistant Examiner*—Mickey Yu
*Attorney, Agent, or Firm*—Mason, Kolehmainen, Rathburn & Wyss

[57] ABSTRACT

This invention relates an electric aeroplane with circular flight whose motor can be controlled in flight by the pilot and whose endurance is increased in a general manner.

8 Claims, 7 Drawing Figures

AEROPLANE WITH CIRCULAR FLIGHT

The object of the present invention is an aeroplane with circular flight driven by an electric motor.

During the last few years, the toy industry has suggested to consumers several types of model aeroplanes which are capable of flying according to the so-called circular flight technique.

This technique comprises providing the aeroplane with a diving rudder which is capable of controlling the movement of the aeroplane, from the ground onwards, by means of two cables which are connected mechanically, on the one hand, to this rudder and, on the other hand, to a control handle which the operator holds in his hand.

The first model aeroplanes which were conceived to fly according to this technique were fitted with an internal combustion engine, either of the diesel type or of the sparking plug type.

However, such aeroplanes are not without numerous disadvantages, since it is relatively tricky to operate them (running-in, starting of the engine, power supply, etc...), and, in addition, the operations which it is necessary to carry out with the fuel (filling of the tank, initial supply to the engine, etc...) are dirty and unpleasant operations.

Finally, one of the main disadvantages with the internal combustion engine is its relatively high noise level caused, in particular, by the high running speed of this engine.

To eliminate these disadvantages, recent developments of aeroplane engines has turned more and more towards electric motors, which have numerous advantages of use, because they cost much less than an internal combustion engine and its accessories, and because they are easier to operate since they only need to be connected to a source of current to make them operate.

Consequently, the aeroplanes with circular flight, which at present are the ones most generally used, comprise an aeroplane, which is fitted with a motor and cells or more generally rechargeable cadmium/nickel batteries, and a double control cable for the diving rudder, plus a handle held by the pilot.

By working this handle, the pilot pulls and slackens inversely the two wires which ensure the mechanical connection between the aeroplane and the handle for controlling the diving rudder, and consequently the manoeuvre of the aeroplane.

Although this type of aeroplane constitutes progress vis-a-vis the aeroplanes with internal combustion engines, it nevertheless has a certain number of disadvantages.

In fact, the cells or the batteries which are placed directly in the aeroplane constitute extremely heavy elements compared with the overall weight of the aeroplane including the electric motor.

Consequently, it is necessary to dimension the electric motor bearing this weight in mind, and it is also necessary for the two mechanical cables, which ensure the connection between the aeroplane and the handle, to resist the developed stresses; this constitutes an additional stress which considerably limits the endurance of the aeroplane which, at best, does not exceed ten minutes.

Moreover, the operation of the electric motor is linked with the starting; this means that, in order to launch his aeroplane, the pilot or his assistant plugs in the motor, the aeroplane then starts immediately, begins to travel along the ground, takes off, then turns without its being possible to stop the motor. The pilot must then cause his aeroplane to turn until the cells or the battery are exhausted, or he is obliged to try and land the aeroplane so as to stop it and manually seize the motor, but this is not an easy operation.

The object of the present invention is to eliminate these disadvantages by creating an electric aeroplane with circular flight whose motor can be controlled in flight by the pilot and whose endurance is increased in a general manner.

For this purpose, the invention relates to an aeroplane with circular flight driven by an electric motor, comprising a diving rudder, composed of one or a plurality of flaps whose displacement controls the ascending and descending movements of the aeroplane, and connected to a control handle by two cables fixed to the two ends of an operating lever which is fitted on board the aeroplane and, by means of a linkage, is capable of controlling the displacement of the flap or flaps.

This aeroplane is characterised in that the cables connecting the aeroplane to the handle are conductors of electricity and are electrically connected, on the one hand, to the electric motor and, on the other hand, to a source of electrical supply in the handle.

Thus, according to the invention, the two cables serve both as electrical connecting elements and mechanical connecting elements; because of this feature, the aeroplane no longer carries the relatively heavy load constituted by the cells or the batteries, and this considerably increases the endurance of the aeroplane. In fact, as the cells or the batteries may represent, in some cases, more than double the weight of the aeroplane without a battery, the endurance of the aeroplane is multiplied up to six times, depending upon whether the aeroplane is used until the endurance of the cells or the battery located in the handle is exhausted.

According to another feature of the invention, the source of electrical supply is a source of continuous current such as a cell or a battery located in the control handle.

In this case, the handle comprises a portion which has a hollow recess for accommodating the source of electrical supply and a loop for gripping purposes.

According to a particularly advantageous variant of the invention, the source of electrical energy is composed of the batteries of a car, or by a voltage changer/-rectifier unit which is supplied from the electric mains (110 volts, 220 volts). However, this feature proves to be particularly advantageous since it considerably reduces the cost price for the running of the aeroplane, since the cells must be changed very frequently, and since, in this case, moreover, the endurance of the aeroplane is unlimited.

It is also possible for the source of energy to be positioned on the operator himself, in his pocket or carried over his shoulder.

According to another variant of the invention, used in the case where the power is supplied by a transformer/rectifier from the mains, the rotational speed of the motor is modified by means of a potentiometer, a variator, etc... This enables the aeroplane to carry out a more complex manoeuvre and consequently there is increased interest in this toy.

The same manoeuvre may also be obtained, in the case where cells supply the power, by using a multipositional switch which connects two, four or six cells and thus causes the voltage, hence the speed, to vary.

According to another feature of the invention, the loop comprises a switch which is capable of switching off or closing the electrical connection between the cables and the supply source; preferably, of course, this switch is placed within thumb range when the hand holds the gripping portion of the handle.

Because of this switch, the operator may switch off the motor's supply and can thus allow the aeroplane to land or slow down.

The present invention will be described in more detail with reference to the attached drawings in which.

Figure 1:
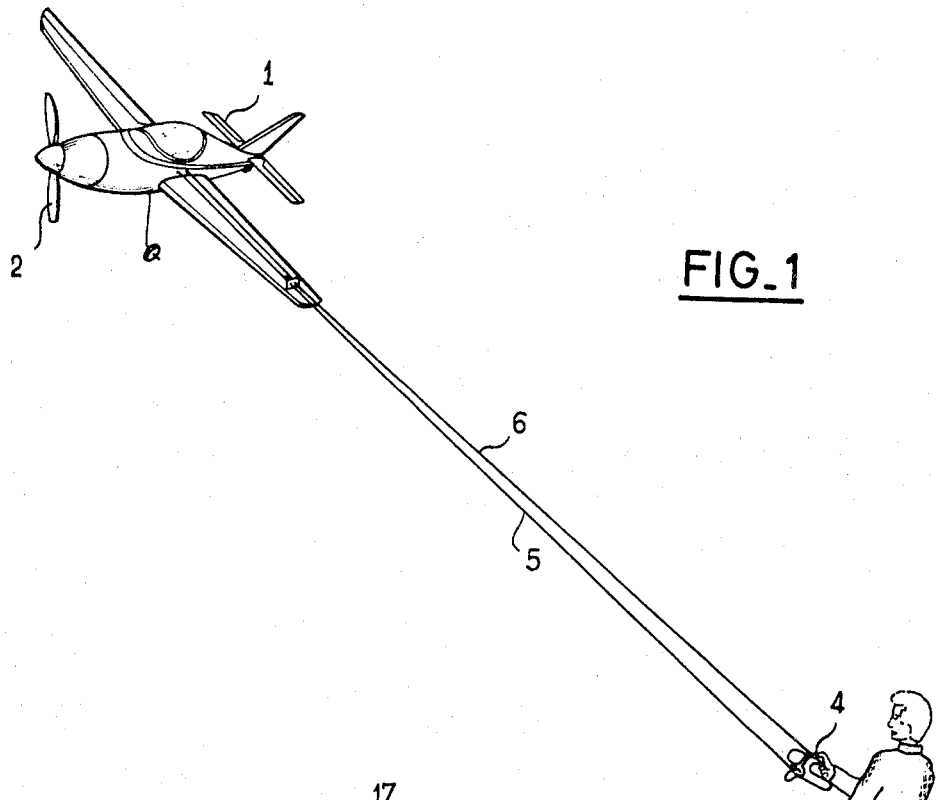
FIG. 1 is a perspective view of an aeroplane with circular flight.

According to FIG. 1, the aeroplane with circular flight, which forms the subject-matter of the invention, comprises, in a very general way, an aeroplane 1 whose propellor 2 is driven by an electric motor, and whose movement is controlled from the ground by means of a handle 4 which is electrically and mechanically connected to the electric and mechanical control elements of the aeroplane 1 by means of two cables 5 and 6.

Figure 2:
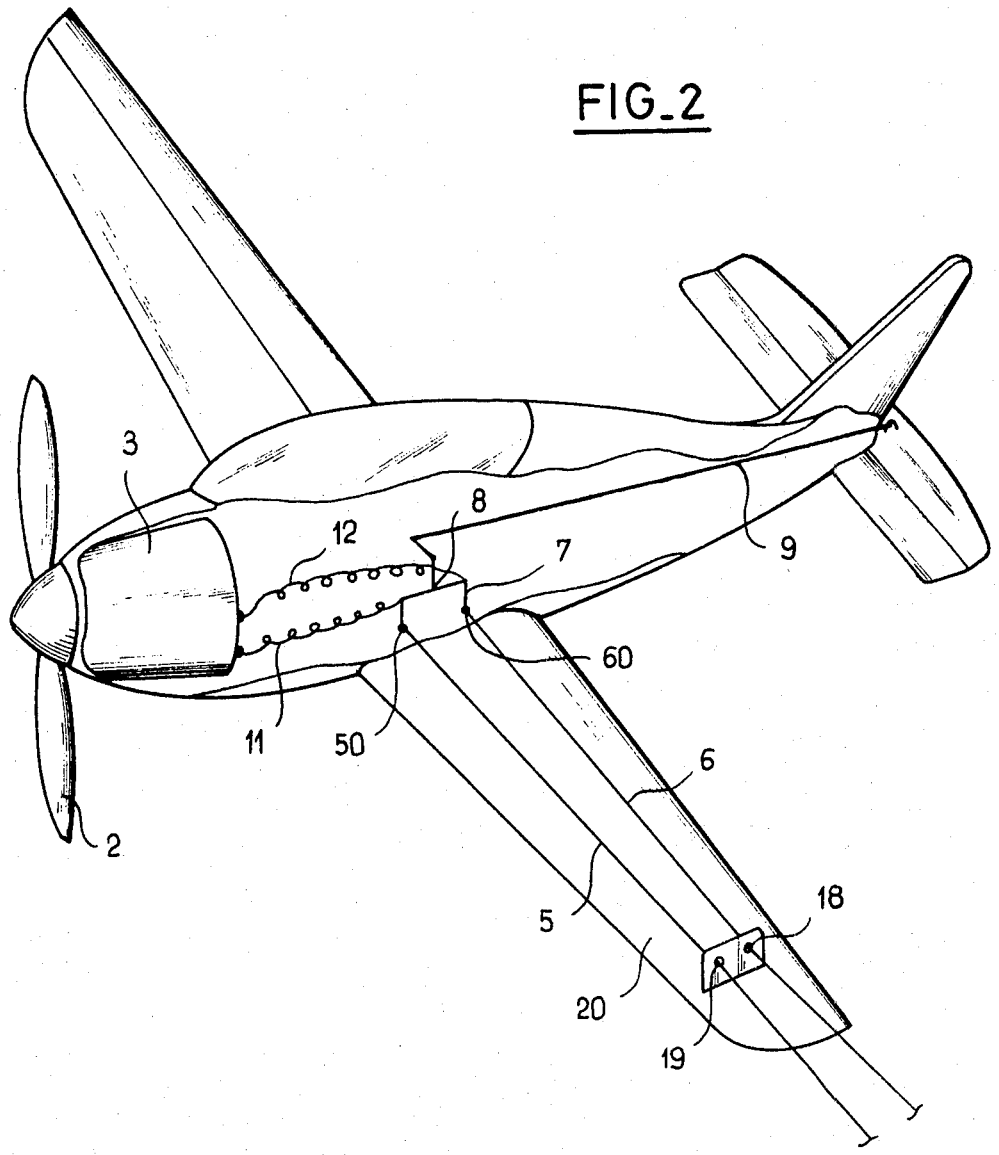
FIG. 2 is a schematic view showing the various parts on board the aeroplane.

According to FIG. 2, the two cables 5 and 6 are connected respectively to the two ends 50 and 60 of a two-armed lever 7 which is articulated at the point 8; to ensure a better stability for the aeroplane as a whole, the cables 5 and 6 pass into two perforations 18 which have been made for this purpose in a clamp 19 provided on one of the wings 20 of the aeroplane.

The lever 7 is connected mechanically, owing to a linkage 9 shown schematically in FIG. 2, to a diving rudder composed of a flap 10 whose displacement controls the ascending and descending movements of the aeroplane.

Consequently, the lever 7, the handle 4 and the two cables 5 and 6 form a deformable parallelogram and, when the handle 4 is worked by pulling on one of the cables 5 and 6 and by freeing the other cable 6 or 5 by an inverse movement, the pivoting of the lever 7 is controlled and consequently the rod 9 and the flap 10 of the diving rudder are controlled.

However, in addition to its mechanical role, the lever 7 is capable of transmitting to the motor 3, and therewith the propellor 2, the electrical energy supplied to the cables 5 and 6 from the handle 4. For this purpose, this lever 7 is supplied in an insulating material, with the exception of the parts 50 and 60 which serve to fix the cables 5 and 6 which are conductors and are connected to the motor 3 by flexible conductors 11 and 12 shown schematically in the Figure.

Thus, according to the invention, it is possible to control the power supply to the motor 3, from the ground, by means of the cables 5 and 6.

Figure 3:
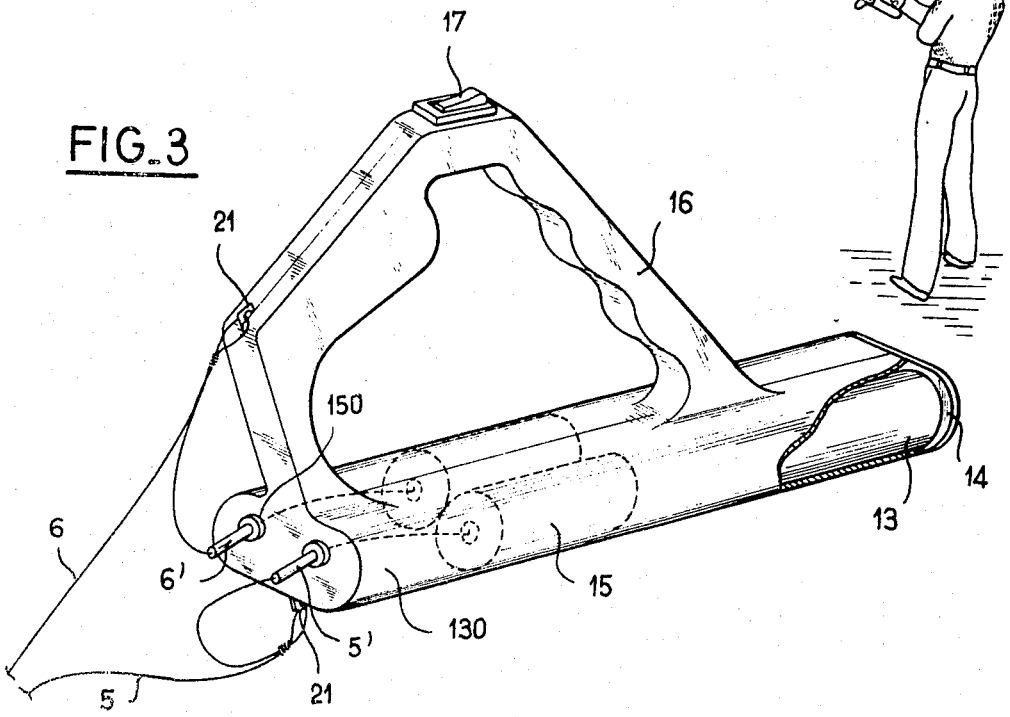
FIG. 3 is a partially cut-away perspective view of a handle according to the invention.

For this purpose and according to FIG. 3, the handle 4 comprises a part 13 having a hollow recess 130 provided with a fixed cover 14 for accommodating the source of electrical supply, for example, from the cells or batteries 15 themselves connected to sockets 150 for accommodating the terminal plugs 5' and 6' of the cables 5 and 6.

To prevent the plugs 5' and 6' from coming out of the sockets 150 during the running of the aeroplane, the ends of the cables 5 and 6 are fastened to clips 21 provided for this purpose on the handle 4.

In addition, the hollow part 14 is connected to a grip portion 16 provided with a button switch 17. This button switch is placed in series on one of the cables 5 and 6 so as to permit the electrical supply to the motor to be switched off in order to stop the aeroplane therefore during operation. The button 17 may also be a push-button which controls a potentiometer cursor or an electronic variator which permits the electrical supply to the motor 3 to be modified so as to cause the motor to turn at different speeds.

According to another feature of the invention, not shown in FIG. 3, the power supply to the motor 3 of the aeroplane 1 may be ensured directly from the mains; in this case, the cables 5 and 6 are directly supplied by a rectified current supplied at a continuous weak voltage (4.5; 6; 9 volts; etc.) from a transformer/rectifier which is not shown.

It is particularly advantageous to combine the two power-supplying methods and to provide a button (not shown) which permits the passage from one supply method (for example, cells) to the other (for example, mains).

This change-over may also be effected automatically by means of the junction socket (not shown) from the handle to the rectified supply connected to the mains.

Figure 4A:
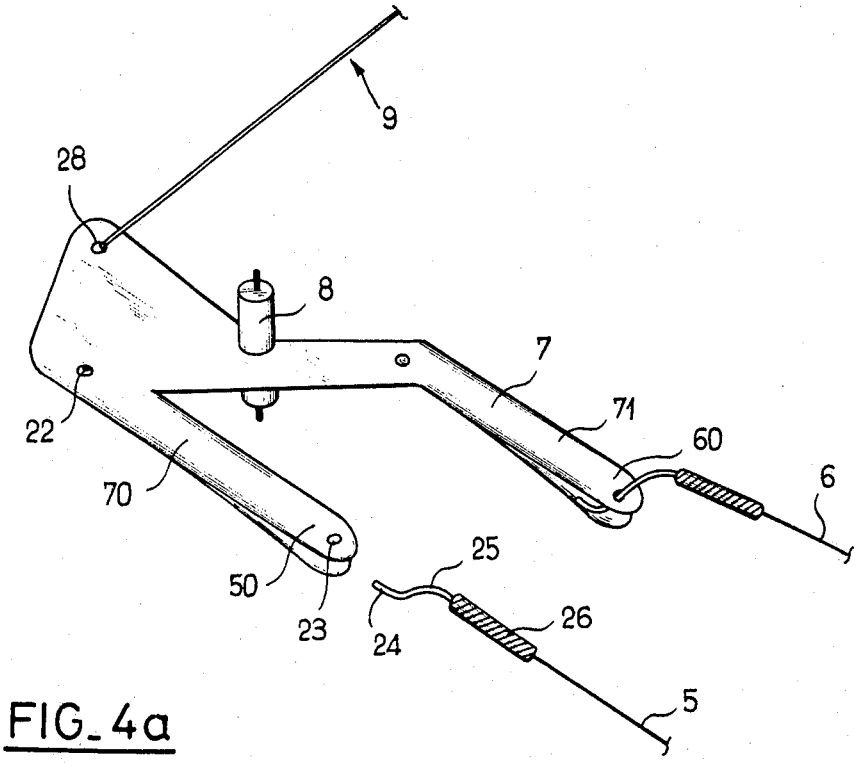
FIGS. 4*a* and 4*b* are respective perspective and sectional views of the lever for controlling the movement of the aeroplane.
Figure 4B:
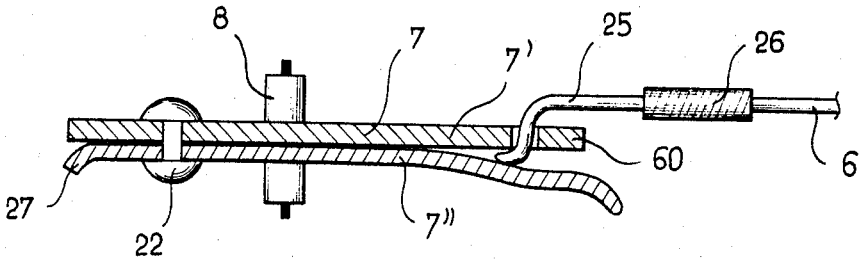

According to FIGS. 4*a* and 4*b*, the two arms 70 and 71 of the lever 7 are actually composed of a small insulating plate 7' which serves as a support and covers a conducting strip 7'' connected to the small plate 7' by means of a rivet 22 (the second strip is not shown).

The ends 50 and 60 of the small insulating plates 7' are provided with perforations 23 for accommodating the rigid ends 25 which are in the form of brass wire grips 24 and are connected to the flexible cables 5 and 6 by means of couplings 26.

When the hooks 24 are inserted in the perforations 23, they come to rest against the conducting strips 7'', thus ensuring the electrical connection between the cables 5 and 6 and the motor 3. For this purpose, the strips 7'' are provided, at their end remote from the grip 24, with clamps 27 on which the conductors 11 and 12, connected to the motor 3, are firmly soldered.

When the hooks 24 are inserted in the perforations 23, this arrangement permits a constant friction to be ensured between these grips 24 and the conducting strips 7'', thus avoiding any risk of the electrical connection being switched off as a result of oxidation (corrosion).

Moreover, the lever 7 comprises a perforation 28 which serves to accommodate the rod 9 for controlling the movement of the flap 10 of the diving rudder.

Figure 5A:
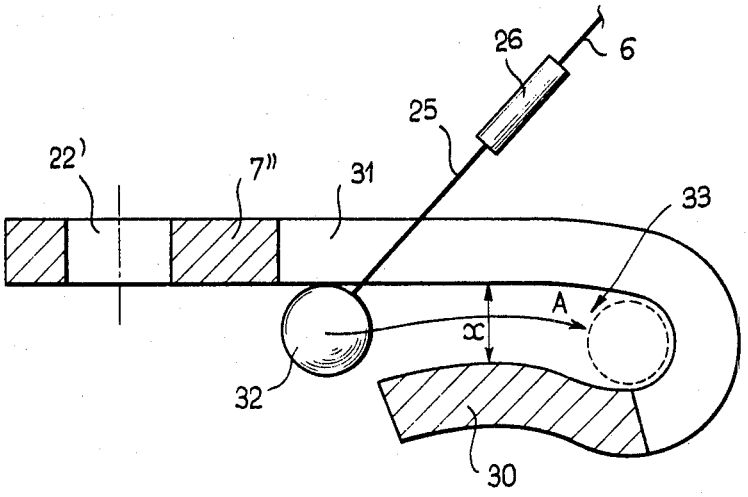
FIGS. 5*a* and 5*b* show a variant of this lever, as a respective sectional view and an underneath view.
Figure 5B:
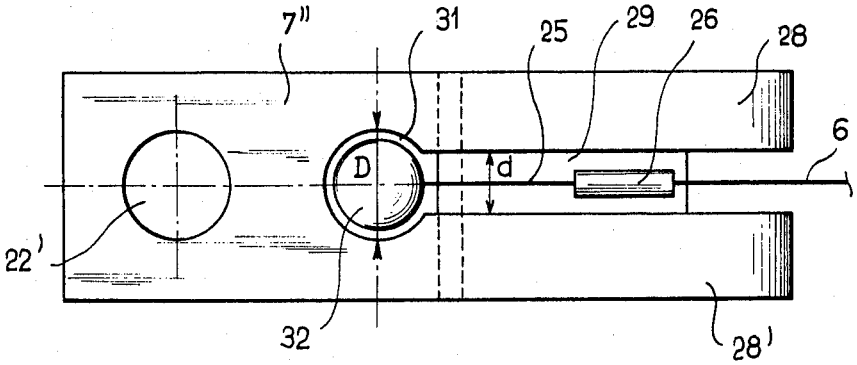

According to the variant shown in FIGS. 5*a* and 5*b*, the conducting strips 7'', which are fixed beneath the small insulating plates 7' by means of rivets 22 which pass in perforations 22' provided for this purpose, are bound, at their ends remote from the perforations 22', by two clamps 28 and 28' which are separated by a longitudinal slot 29 and are bent downwards at their ends to form hooks 30.

The slot 29 corresponds to a slot 29', which is not shown and is provided in the small plate 7', and is bound by an enlarged portion 31 which permits the introduction of a conducting ball 32 fixed to the end of each brass wire 25 and replaces the grips 24 shown in FIGS. 4*a* and 4*b*.

The conducting ball 32 has a diameter between the diameter D of the enlarged portion 31 and the width d of the slot 29.

Consequently, when the ball 32 has been introduced into the portion 31, it wedges in the portion 33 defined by the hook 30, as per arrow A, so as to adopt the position shown by dotted lines in FIG. 5*a*.

In this position, the ball 32 rests against the conducting hook 30 and can thus ensure the electrical connection between the motor 3 and the cables 5 and 6.

The form of the hook is provided in such a manner that the width x of its central portion is less than the diameter of the conducting ball 32, thus permitting the ball 32 to be kept in the position shown by dotted lines by a catch effect.

I claim:

1. A model aeroplane adapted for circular flight and powered by an electric motor therein, said aeroplane including a diving rudder comprising one or more flaps pivoted for angular displacement to control the ascending and descending movements of the aeroplane, a control handle connected to the aeroplane by a pair of cables secured to respective end portions on a pair of arms of an operating lever pivotally mounted on the aeroplane, a linkage member connected between said lever and said rudder controlling the angular displacement of said flaps, said cables formed of electrically conductive material and connected between said electric motor and a source of electricity in said handle, said lever formed of insulating material and said end portions serving to mechanically connect said cables and said flaps, said end portions of said arms being formed with a perforation for accommodating a rigid end element in the form of a conductive wire grip connected to a cable by means of a coupling, and each arm including an electrically conducting strip in electrical connection between one of said cables and said motor.

2. The aeroplane according to claim 1, characterized in that the source of electrical supply comprises a source of continuous current such as an electrovoltaic cell or battery mounted in said control handle.

3. The aeroplane according to claim 1 or 2, characterized in that said handle includes a portion having a hollow recess for holding said source of electrical supply and a loop for gripping purposes.

4. The aeroplane according to claim 3, characterized in that said loop is provided with a manually controlled switch interconnected between said cables and said source of electricity and operable to open or close the electrical connection therebetween.

5. The aeroplane according to claim 4, characterized in that said switch is placed within thumb range for the hand when gripping the loop portion of said handle.

6. The aeroplane according to claim 1 characterized in that the source of electricity comprises a voltage transformer/rectifier unit adapted to be supplied with power from electric supply mains.

7. The aeroplane according to claim 1 characterized in that said handle is provided with a control element cable of modifying the rotational speed of said motor.

8. The aeroplane according to claim 1 characterized in that the end portion of each arm is provided with a clamp member having a pair of fingers separated by a longitudinal slot and bent downward at the end to form a hook capable of wedging, by a catch effect, a ball of electrically conductive material mounted on the end of a cable to provide electrical connection between the cables and the motor.

* * * * *